United States Patent [19]

Noryk

[11] 3,995,432

[45] Dec. 7, 1976

[54] COLLECTOR

[75] Inventors: Leonard Noryk, South Windsor, Conn.

[73] Assignee: United Technologies Corporation, Hartford, Conn.

[22] Filed: July 28, 1975

[21] Appl. No.: 599,559

[52] U.S. Cl. ..... 60/697; 415/209

[51] Int. Cl.[2] ..... F01D 25/30

[58] Field of Search ..... 415/209, 210; 60/39.16, 60/39.36, 694, 695, 697

[56] References Cited

UNITED STATES PATENTS

| | | | |
|---|---|---|---|
| 2,458,730 | 1/1949 | Ponomareff | 415/209 |
| 2,709,893 | 6/1955 | Birmann | 60/39.36 |
| 2,840,342 | 6/1958 | Silver | 60/697 |
| 3,552,877 | 1/1971 | Christ et al. | 415/209 |
| 3,601,983 | 8/1971 | Guillot | 60/39.16 |
| 3,609,966 | 10/1971 | Guillot | 60/39.16 |

FOREIGN PATENTS OR APPLICATIONS

| | | | |
|---|---|---|---|
| 15,053 | 12/1926 | Netherlands | 415/209 |

*Primary Examiner*—Henry F. Raduazo
*Attorney, Agent, or Firm*—Norman Friedland

[57] ABSTRACT

A toroidal shaped collector with a radial inlet and a single discharge outlet includes a pair of substantially parallel spaced baffle plates extending from the inlet partway into the collector chamber, disposed in the plane of the collector and serves to receive and discharge the airflow from a gas generator such as a gas turbine engine particularly adapted for nonaircraft applications.

5 Claims, 2 Drawing Figures

COLLECTOR

BACKGROUND OF THE INVENTION

This invention relates to collectors and particularly to collectors adapted to receive and discharge the exhaust gases of a gas turbine type power plant or other gas generating systems.

As is generally known in the art, collectors serve to receive exhaust gases from a gas generator so as to divert the exhaust gas streams. For example, a free turbine industrial power plant operation which has a shaft extracting power from the free turbine would include a collector axially downstream of the free turbine so as to divert the exhaust gases 90° from the engine axis and away from the free turbine drive shaft.

Also, well known in the art, collectors are typically toroidally shaped and surround the power plant exhaust pipe, which in a free turbine installation as noted above would be downstream of the free turbine. Generally the collector has a radial or substantially radial inlet and a single discharge pipe. The flow entering the collector on the opposite side of the discharge pipe has to make a turn to reach the discharge pipe. As a consequence this turning flow produces a high pressure region at the opposite end of the discharge outlet.

This high pressure region in turn interferes with the flow around the circumference of the inlet causing distortion of the inlet flow and generally impairing the capacity of the collector from discharging flow effectively. One of the solutions to such problems is to design a large collector that could accommodate a larger flow. Obviously, the solution not only adds to the size, weight and expense, it may not be tolerable where the envelope to accommodate the collector is not sufficiently large.

I have found that I can obviate the problems noted above by incorporating parallel spaced baffles extending from the inlet in the collector mounted in the plane of the collector and achieve the following:

1. obtain higher specific flows in a collector without introducing circumferential distortion of the inlet flow
2. do not sacrifice structural integrity and
3. reduce the size of an installation for a given collector capacity.

This invention also contemplates incorporating a screen or perforated plate to serve as a blockage located in proximity to the inlet opposite the discharge outlet and extending circumferentially to span the opening of the outlet. The porosity of the blockage is selected so that the pressure drop thereacross should approximate the velocity head of the flow egressing from between the baffle into the curved passage formed by the baffles and walls of the torus. The blockage should be used only in cases when even a small circumferential inlet distortion cannot be tolerated.

SUMMARY OF THE INVENTION

An object of this invention is to provide an improved collector for receiving and discharging fluid.

A still further object of this invention is to provide for a collector as described with baffles extending from the inlet of the collector partway into the collector chamber.

A still further object of this invention is to provide for a collector as described with internal parallelly spaced baffles extending the inlet into the baffle chamber and disposing a porous blockage in proximity to the inlet opposite the wall carrying the exhaust pipe and selecting the porosity so that its pressure drop substantially equals the velocity head of the flow in the curved passages created by the baffles.

Other features and advantages will be apparent from the specification and claims and from the accompanying drawings which illustrate an embodiment of the invention.

DESCRIPTION OF THE PREFERRED EMBODIMENT

Figure 1:
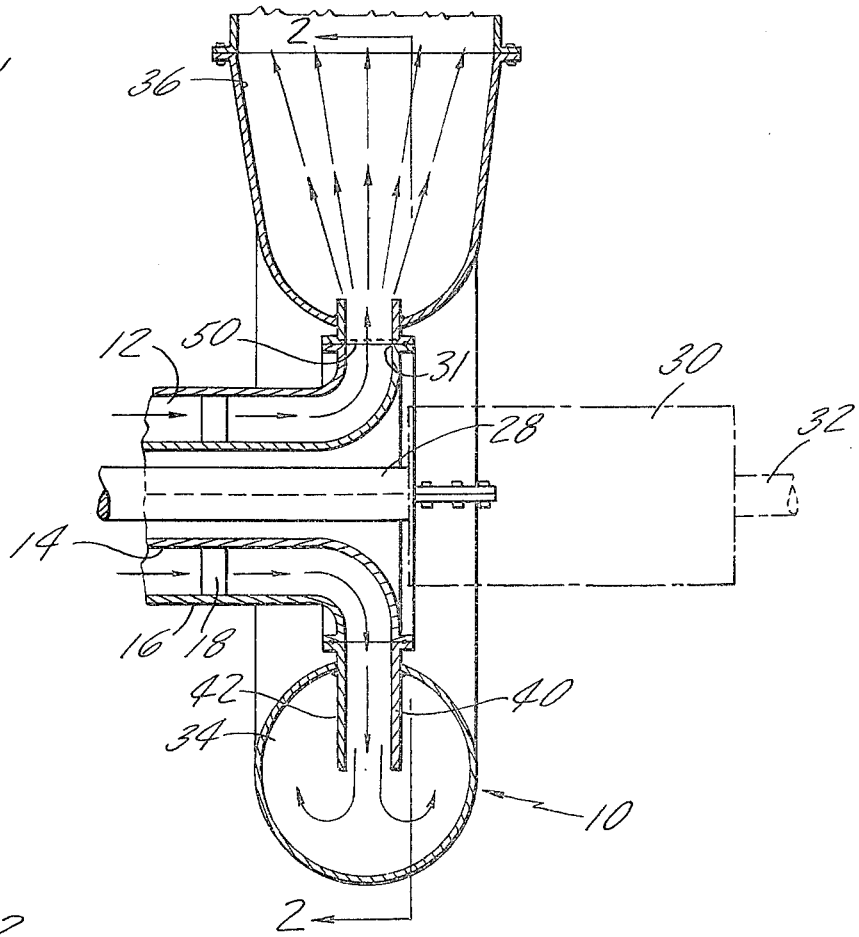
FIG. 1 is a partial view, partly in section and partly in schematic illustrating the preferred embodiment of this invention.
Figure 2:
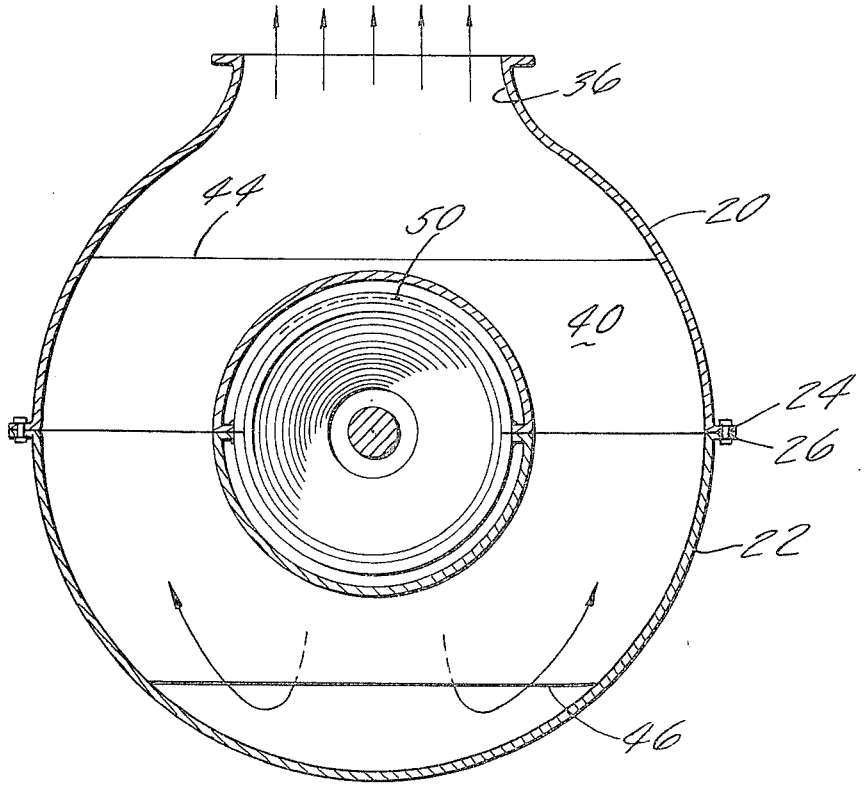
FIG. 2 is a view taken along line 2-2 of FIG. 1.

Reference is made to FIGS. 1 and 2 showing the details of the preferred embodiment. As shown, the collector generally illustrated by reference numeral 10 receives the discharge from the free turbine of a turbine type power plant (not shown), through the annular passage 12 defined by the coaxial ducts 14 and 16. Conventional turning vanes 18 may be utilized to guide the flow into the collector.

Collector 10 is formed in the shape of a toroid which may be formed from two separate halves 20 and 22 of sheet metal or plate stock joined at the center taken through the plane of the collector. The two halves may be joined by any suitable means such as bolting or welding along the complementary flanges 24 and 26. In this particular installation the drive shaft 28 (driven by the free turbine) extends along the engine axis centrally of the torus. A gearbox depicted by the blank box 30 and the drive shaft 32 illustrates one type of mechanism that can be used to extract work.

The flow from the annular passage 12 is admitted radially into the collector chamber 34 through annular inlet 31 on the inner portion of the torus wall. An exhaust pipe 36 may be connected to an exhaust stack (not shown) for discharging the exhaust gas in a direction away from gearbox 30 and in this instance 90° from the engine center line.

According to this invention, generally flat plate baffles 40 and 42 disposed adjacent to and circumferentially extending about the inlet 31 are parallelly spaced and extend to the side walls of the torus. Each baffle is similarly shortened about edges 44 and 46 and aligned with the end of ducts 14 and 16 so that flow admitted to the collector opposite the exhaust port 36 is directed between the baffle plates where it turns and flows to the torus chamber around the foreshortened edge 46 and ultimately to the exhaust port 36. By virtue of the baffles the flow only has limited entrance openings to the high pressure region which is directly opposite the exhaust port 36. Hence this flow reaches the exhaust port without interference of flow from other circumferential locations.

Additionally, circumferential uniformity of flow is enhanced by including blockage element 50 which may be in the form of a screen or perforated plate extending across inlet 31 a circumferential distance to span the exhaust port 36 and is wedged between the spaced baffles 40 and 42. The porosity of blockage element 50 is selected so that the pressure drop thereacross approximately equals the velocity head of the curved flow created by the baffles.

It should be understood that the invention is not limited to the particular embodiments shown and described herein, but that various changes and modifications may be made without departing from the spirit or scope of this novel concept as defined by the following claims.

I claim:

1. A collector for a gas producer for collecting and diverting the gaseous discharge therefrom, said collector having wall means defining a toroidally shaped chamber having an annular inlet on the inner diameter of said wall means for receiving said gaseous discharge from a gas producer and a single outlet opening on the outer diameter of said wall means for discharging the collected gases, means for increasing the flow into and out of said toroidally shaped chamber including a pair of plate elements extending radially from opposite sides of said annular inlet to said wall means but terminating radially short of the wall means at the junction point opposite said outlet said spaced plate elements defining three sub-chambers communicating with said single outlet whereby the gaseous discharge from said inlet is directed between said plate-like elements forming one of said sub-chambers into both of said other sub-chambers after turning in said toroidally shaped chamber to discharge through said outlet.

2. A collector as claimed in claim 1 including a blockage means in said inlet extending between said spaced parallel plate-like elements and substantially spanning the dimension of said discharge opening.

3. A collector as claimed in claim 1 including a porous blockage means extending between said plate-like elements at said inlet disposed opposite said outlet and dimensioned to substantially span the diameter of said outlet.

4. A collector as claimed in claim 1 wherein the porosity of said blockage means is substantially equal to the velocity head of said curved flow.

5. A collector as claimed in claim 4 wherein said blockage means is a screen.

* * * * *